United States Patent [19]

Parsons

[11] Patent Number: 4,972,980

[45] Date of Patent: Nov. 27, 1990

[54] PACIFIER HOLDER

[75] Inventor: Geraldine A. Parsons, Valley Grove, W. Va.

[73] Assignee: P & L Industries, Inc, Valley Grove, W. Va.

[21] Appl. No.: 364,112

[22] Filed: Jun. 12, 1989

[51] Int. Cl.[5] ..... A45F 5/02

[52] U.S. Cl. ..... 224/194; 24/3 M; 24/462

[58] Field of Search ..... 224/182, 194, 220; 24/3 M, 90 C, 90 E, 459, 462; 128/360

[56] References Cited

U.S. PATENT DOCUMENTS

| | | | |
|---|---|---|---|
| D. 225,039 | 10/1972 | Sauritis . | |
| D. 276,939 | 12/1984 | Pascoe . | |
| D. 280,749 | 9/1984 | Thomson et al. . | |
| 651,497 | 6/1900 | Ware . | |
| 954,066 | 4/1910 | Ware . | |
| 1,235,169 | 7/1917 | Tallon . | |
| 1,287,295 | 12/1918 | Guenther . | |
| 1,623,969 | 4/1927 | Palmer . | |
| 1,888,167 | 11/1932 | Glenn . | |
| 3,392,729 | 7/1968 | Lenoir | 24/462 |
| 3,865,290 | 2/1975 | Sperling | 224/194 |
| 3,893,212 | 7/1975 | Curry | 24/462 |
| 4,277,910 | 7/1981 | Kramer | 128/360 |
| 4,329,996 | 5/1982 | Copeland . | |
| 4,765,037 | 8/1988 | Perry | 24/301 |

*Primary Examiner*—Linda J. Sholl

*Attorney, Agent, or Firm*—Laubscher Presta & Laubscher

[57] ABSTRACT

An improved pacifier holder is characterized by an ornamental member having an ornamental front surface with integral snap lock means connected with the rear surface thereof, and a snap ring removably connected with the snap lock assembly of the ornamental member, whereby when a piece of fabric such as an article of infant clothing is arranged between the ornamental member and the snap ring, the ornamental member is connected with the fabric. A cloth strap is connected at one end with the ornamental member and a fastening mechanism such as a VELCRO-type fastener is connected with the other end of the strap for receiving and connecting a pacifier therewith.

3 Claims, 2 Drawing Sheets

FIG. 6
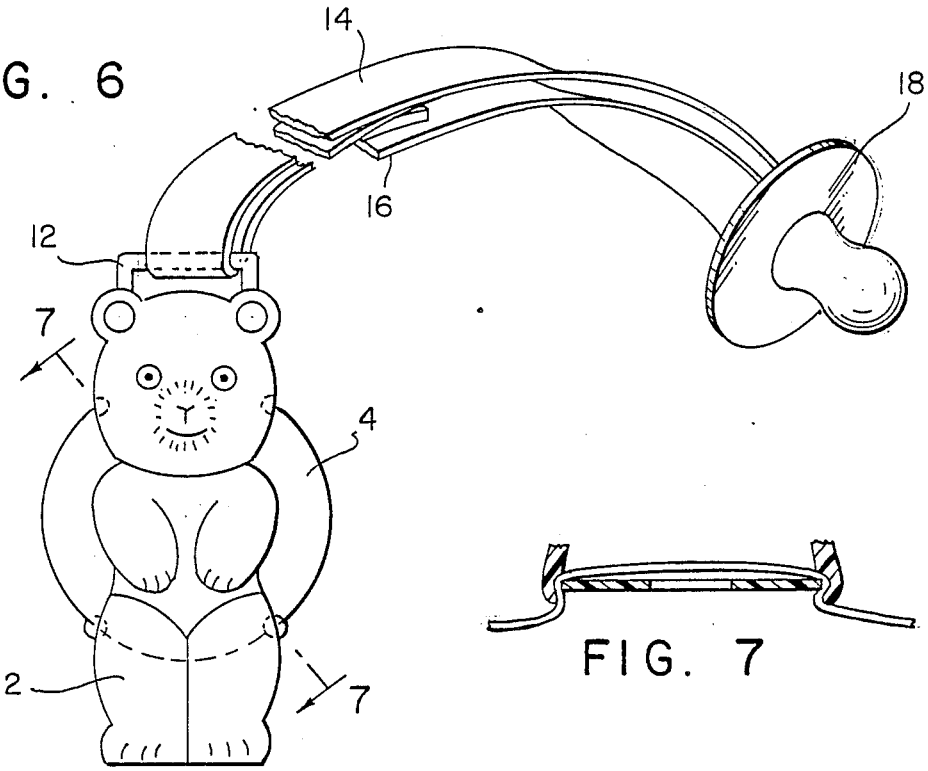
FIG. 7
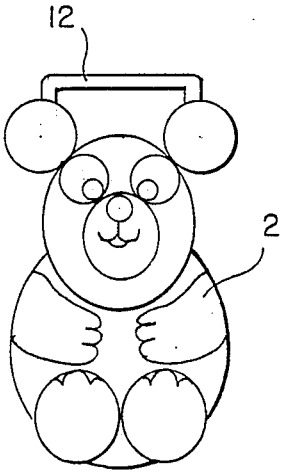
FIG. 8
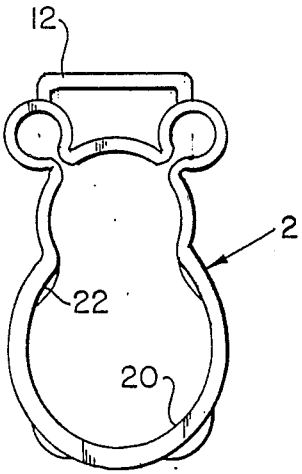
FIG. 9
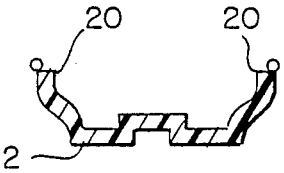
FIG. 10

PACIFIER HOLDER

BACKGROUND OF THE INVENTION

The present invention relates to an improved safety pacifier holder which is fastened to the clothing of an infant. The holder includes a strap having a pacifier fastened at its remote end so that the pacifier will always be tethered to the infant, even when not in use.

BRIEF DESCRIPTION OF THE PRIOR ART

Pacifier holders are well-known in the patented prior art. For example, the U.S. Patents to Ware No. 651,497, Ware No. 954,066, Guenther No. 1,287,295, and Palmer No. 1,623,969 all disclose pacifier holders comprising cords or the like which are used to fasten the pacifier to an article of furniture or which are looped around the infant's neck to prevent the pacifier from becoming lost.

An obvious drawback of these cord devices is that the infant can accidently be choked by the cord.

Also known in the art are pacifier clips or fasteners which are adapted to be connected with the infant's clothing, as evidenced by the patent to Lenoir No. 3,392,729. This patent discloses a plug type fastener for connection with the infant's clothing and a cord connecting the pacifier with the fastener. The cord presents the same drawbacks as discussed above in that an infant can accidently be choked to death. Moreover, the fastener of Lenoir as well as the prior clip-on type fasteners have a tendency to become detached from the infant's clothing when a pulling force is applied to the cord.

Finally, many of the aforementioned pacifier holders have either not been approved or have been recalled by the Consumer Product Safety Commission for failure to meet minimum safety standards for infant use. For example, in addition to the risk of choking, many of the prior pacifier holders are formed of toxic materials which can poison an infant if placed in the infant's mouth. Other holders are formed of rigid metals which can cut an infant's mouth or break a tooth if the infant accidently chews on them.

The present invention was developed in order to overcome these and other drawbacks of conventional pacifier holders by providing a safe pacifier holder which is easy to connect with an infant's clothing to retain the pacifier in the vicinity of the infant at all times.

SUMMARY OF THE INVENTION

Accordingly, it is primary object of the present invention to provide a pacifier holder including an ornamental member having an ornamental front surface and a snap lock assembly integrally connected with the rear surface thereof. A circular snap ring is removably connected with the snap lock assembly of the ornamental member, so that when a piece of fabric is arranged between the ornamental member and the snap ring, the ornamental member is connected with the fabric. A strap is connected at one end with the ornamental member and a fastening device is connected with the other end of the strap for fastening a pacifier thereto.

The ornamental member and snap ring are preferably formed of a non-toxic synthetic plastic material, and the snap lock assembly at the rear of the ornamental member is preferably resilient for outward deflection to receive and release the outer edge of the snap ring.

According to one embodiment, the snap lock assembly comprises a plurality of tabs arranged in spaced relation about a circle having a diameter slightly less than the outer diameter of a circular snap ring so that the tabs retain the ring in a snap lock fashion.

According to a second embodiment of the invention, the snap lock assembly comprises a circular rim having an inner diameter slightly less than the outer diameter of the circular snap ring, the rim retaining the snap ring in a snap lock fashion.

The fastener at the remote end of the strap preferably comprises a VELCRO fastener which is looped through the end of the pacifier for releasably fastening any conventional pacifier.

BRIEF DESCRIPTION OF THE FIGURES

Other objects and advantages of the invention will become apparent from a study of the following specification when viewed in the light of the accompanying drawing, in which:

FIG. 6 is a plan view of the pacifier holder with the snap ring connected with the ornamental member and illustrating a pacifier connected with the end of the strap;

FIG. 7 is a sectional view taken along line 7—7 of FIG. 6; and

FIGS. 8, 9 and 10 are front, rear and sectional views of an alternate embodiment of the ornamental member of the pacifier holder.

DETAILED DESCRIPTION

Figure 1:
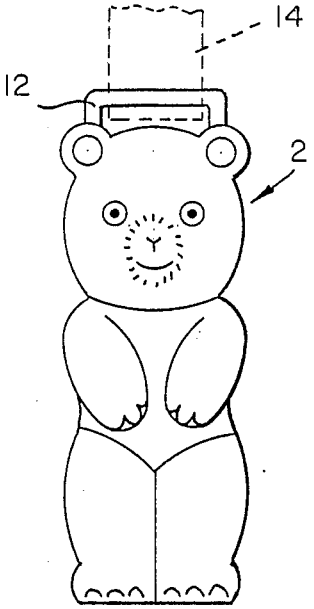
FIGS. 1, 2, and 3 are front, side and rear plan views of the ornamental member of a first embodiment of the pacifier holder according to the invention.
Figure 2:
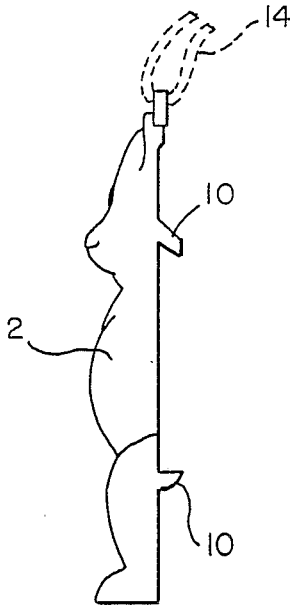
Figure 3:
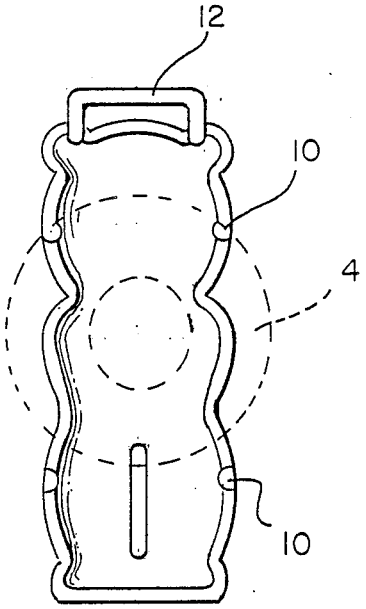

The preferred embodiment of the pacifier holder according to the invention will be described with reference to FIGS. 1–7. As shown in FIGS. 1–3, the pacifier holder includes an ornamental member 2 having an ornamental front surface and a snap lock assembly integrally connected with the rear surface thereof. The ornamental member 2 is preferably formed of a non-toxic synthetic plastic material which may be quickly and inexpensively manufactured via a molding technique. As shown in the drawing, the member has an ornamental configuration which in this instance is a representation of a toy bear. Of course, other animal and/or ornamental designs may be provided on the front surface of the member by reconfiguring the mold.

Figure 4:
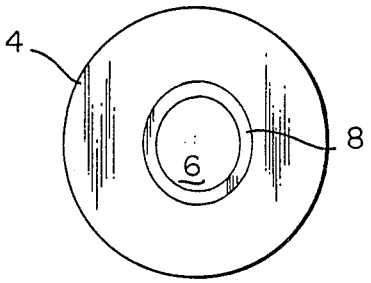
FIGS. 4 and 5 are front and side plan views of the snap ring of the pacifier holder.
Figure 5:
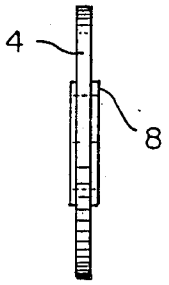

FIGS. 4 and 5 illustrate the snap ring 4 which is removably connected with the snap lock assembly of the ornamental member. The snap ring is also preferably formed of a non-toxic synthetic plastic material and has a generally circular configuration as shown in FIG. 4. The snap ring includes a central aperture 6 surrounded by a raised portion 8 of the ring which increases the rigidity of the ring 4.

The snap lock assembly according to the preferred embodiment of FIGS. 1–6 comprises a plurality of tabs 10 extending from the rear surface of the ornamental member as shown in FIGS. 2 and 3. These tabs are preferably resilient for outward deflection to receive and release the outer edge of the snap ring 4. More particularly, the tabs are arranged in spaced relation about a circle at the rear of the ornamental member as shown in FIG. 3. The diameter of the circle containing the plurality of tabs is slightly less than the outer diameter of the snap ring, whereby the tabs contain the snap ring in a snap lock connection fashion.

As shown in FIGS. 6 and 7, a piece of fabric such as an article of clothing worn by an infant, is arranged between the ornamental member 2 and the snap ring 4, following which the snap ring is connected with the snap lock assembly of the ornamental member. In this fashion, the ornamental member is connected with the outer surface of the article of clothing, with the snap ring being retained adjacent the inner surface of the article of clothing.

The top of the ornamental member includes an integral bracket 12 to which is sewn the end of a strap 14 of non-toxic cloth material. At the remote end of the strap 14 is provided a VELCRO-type fastener 16. The free end of the strap is looped through the end of the pacifier 18 and folded back for connection via the VELCRO fastener 16 to attach the pacifier to the free end of the strap. Since the VELCRO-type fastener may easily be unfastened, different pacifiers may be substituted on the pacifier holder.

With the pacifier holder ornamental member 2 connected with an article of infant clothing, the pacifier will always remain tethered to the infant and within easy reach for the infant to place the pacifier in its mouth for sucking. Since all of the materials are formed of soft non-toxic material, there is no danger that the pacifier holder can harm the infant.

Referring now to the alternate embodiment of FIGS. 8–10, the ornamental holder 2 is shown having a slightly different configuration and an alternative type of snap lock assembly integrally connected with the rear surface thereof. More particularly, as shown in FIGS. 9 and 10, the snap lock assembly of FIGS. 8–10 comprises a portion of a circular rim 20 extending generally about the peripheral edge of the body portion of the ornamental bear-like figure of the ornamental member 2. The rim 20 preferably has an inner diameter slightly less than the outer diameter of the snap ring 4. Thus, when the snap ring is connected with the rim 20, the ring is grasped almost completely about its outer edge. This type of assembly provides an even greater connection force between the ornamental member and the snap ring, which thus requires greater force to dislodge the pacifier holder from the infant's clothing. If desired, additional projections 22 may be provided in spaced relation to the rim to further assist connection of the snap ring with the ornamental member. As in the embodiment of FIGS. 1–7, the rim and projections 22 are somewhat resilient, whereby they may be deflected outwardly to receive and release the edge of the snap ring.

The pacifier holder according to both embodiments of the invention has been specifically designed to maximize its safety for use with an infant. Thus, for example, the ornamental body member and the snap ring are formed of non-toxic synthetic plastic material and are of such a size that they cannot be swallowed by an infant. The strap is formed of a soft cloth material which has proven to be safer for use with children than strings, ribbons, cords, and the like. Moreover, the pacifier holder and cloth strap can be easily removed from an infant's clothing and washed with other infant apparel in a washing machine.

While in accordance with the provisions of the patent statute the preferred form and embodiments of the invention has been illustrated and described, it will be apparent to those of ordinary skill in the art that various changes and modifications may be made without deviating from the inventive concepts set forth above.

What is claimed is:

1. A pacifier holder, comprising (a) an ornamental member having an ornamental front surface and snap lock means integrally connected with the rear surface thereof, said snap lock means comprising a plurality of resilient tabs arranged in spaced relation about a circle;

(b) a snap ring removably connected with said tabs of said ornamental member, said snap ring having an annular configuration including a central portion of increased thickness to increase the rigidity of the ring and an outer portion having an outer diameter slightly greater than the diameter of the circle containing said tabs, whereby when a piece of fabric is arranged between said ornamental member and said snap ring and said ring is pressed against said resilient tabs, said tabs are initially bent outwardly around the outer portion of said ring and subsequently snap back to a normal position to retain the fabric and said ring therein, thereby connecting said ornamental member to the fabric;

(c) a strap having one end connected with said ornamental member; and (d) fastening means connected with the other end of said strap for removably fastening a pacifier thereto.

2. A pacifier holder as defined in claim 1, wherein said ornamental member and said ring are formed of synthetic plastic material.

3. A pacifier holder as defined in claim 2, wherein said fastening means comprises a hook and pile fastener.

* * * * *